US006478095B2

(12) United States Patent
Neumaier

(10) Patent No.: US 6,478,095 B2
(45) Date of Patent: Nov. 12, 2002

(54) HAND-HELD POWER TOOL

(75) Inventor: Anton Neumaier, Fürstenfeldbruck (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/882,982

(22) Filed: Jun. 15, 2001

(65) Prior Publication Data

US 2001/0052417 A1 Dec. 20, 2001

(30) Foreign Application Priority Data

Jun. 16, 2000 (DE) ..... 100 29 728

(51) Int. Cl.[7] ..... E02D 7/02
(52) U.S. Cl. ..... 173/48; 173/201
(58) Field of Search ..... 173/47, 480, 178, 173/201, 216

(56) References Cited

U.S. PATENT DOCUMENTS 3,828,865 A * 8/1974 Schnizler, Jr. ..... 173/104
4,236,588 A * 12/1980 Möldan et al. ..... 173/48
4,971,156 A * 11/1990 Wong ..... 173/12
6,015,017 A * 1/2000 Lauterwald ..... 173/48

* cited by examiner

*Primary Examiner*—Rinaldi I. Rada
*Assistant Examiner*—Thanh Truong
(74) *Attorney, Agent, or Firm*—Sidley Austin Brown & Wood, LLP

(57) ABSTRACT

A hand-held tool with more than two modes of operation and including a clutch pusher (4) at least partially located in the tool housing and fixedly connected with a bevel gear engaging a bevel gear (9) supported on the drive spindle (3), and at least one engagement cam (6) which connects the clutch pusher (4) with driving gears (11) with a possibility of axial displacement of the clutch pusher relative thereto in the first and second modes of operation, with the spindle, in the third mode of operation, being stopped without a possibility of rotation relative to the tool housing, and with the engagement cam (6) engaging in a recess (7) provided in the housing.

4 Claims, 1 Drawing Sheet

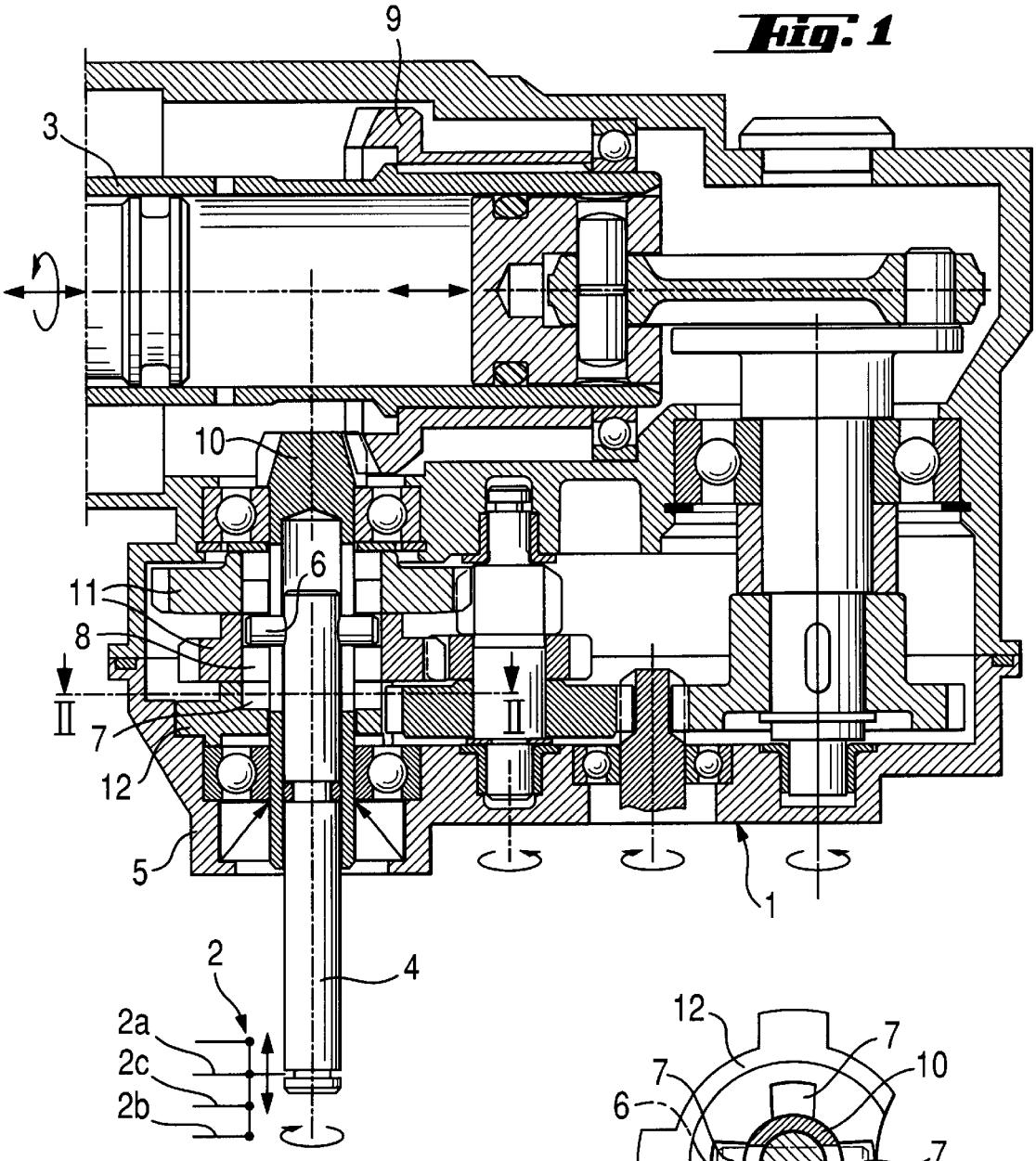
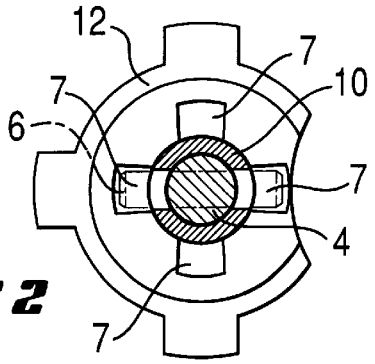
Fig. 2

HAND-HELD POWER TOOL

BACKGROUND OF THE INVENTION

1. Field of the Invention

The present invention relates to a hand-held power tool such as, e.g., a combination hammer, having more than two different modes of operation.

2. Description of the Prior Art

A multi-purpose or combination hammer has, in addition to a rotary drive for producing a rotational movement, another drive, e.g., a percussion drive.

In one of the operational modes of the combination hammer, the rotary drive is separated from the working tool-receiving spindle, with the spindle being secured to hammer housing without a possibility of rotation relative to the housing.

German Publication DE 27 28 961 discloses a combination hand-held power tool which has a change-over clutch displaceable along the spindle and connected with the spindle for joint rotation therewith. The change-over clutch is displaced with a mode selector switch and has one of its end faces connectable with a pinion of the power tool drive and the other of its end faces connectable with a pinion secured to the tool housing. In the later case, the spindle becomes connected with the housing without a possibility of rotation relative thereto.

German Publication DE 19 38 660 discloses a hammer drill provided with a clutch pusher, which extends transverse to the tool spindle and which is displaced by a mode selector switch for changing the rotational speed of the spindle. An engagement cam, which is formed as a pin and is associated with the clutch pusher, connects alternatively, upon displacement of the clutch pusher, two different, step-forming, pinions of the tool drive with a bevel pinion that engages a pinion supported on the tool spindle. A fixed connection of the spindle with the housing without possibility of rotation relative thereto does not find any application in the hammer drill.

Each of the above-discussed publication discloses a hand-held power tool with two modes of operation.

Accordingly, an object of the present invention is to provide a hand-held power tool with more than two modes of operation which can be easily realized.

SUMMARY OF THE INVENTION

This and other objects of the present invention, which will become apparent hereinafter, are achieved by providing a hand-held power tool having at least three modes of operation and including a clutch pusher at least partially located in the tool housing and fixedly connected with a bevel gear for joint rotation therewith, with the bevel gear engaging a bevel gear supported on the drive spindle. The tool includes at least one engagement cam connecting the clutch pusher with driving gears for joint rotation therewith, with a possibility of axial displacement of the clutch pusher relative thereto, in the first and second modes of operation. According to the present invention, in the third mode of operation, which is obtained by displacement of the clutch pusher, the spindle is stopped without a possibility of rotation relative to the housing with the engagement cam engaging in a recess provided in the housing. Advantageously, the hand-held power tool has a fourth mode of operation in which the clutch pusher occupies a position in which the engagement cam rotates in a free space, with the spindle being freely rotatable.

Advantageously, the fourth position of the clutch pusher, which corresponds to the fourth mode of operation, is located between the second and third positions thereof.

Advantageously, the first and second positions of the clutch pusher correspond to first and second modes of operation in which the spindle rotates with two different rotational speeds.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiments when read with reference to the accompanying drawings.

BRIEF DESCRIPTION OF THE DRAWINGS

The drawings show:

FIG. 1 a cross-sectional view of a drive unit according to the present invention for a hand-held power tool; and FIG. 2 a cross-sectional view of portion of the drive unit shown in FIG. 1.

DETAILED DESCRIPTION OF THE PREFERRED EMBODIMENTS

A drive unit or drive 1 according to the present invention for a hand-held power tool, and which is shown in FIG. 1, has several modes of operation 2 for producing a rotational and percussion movement of a tool spindle 3. In addition to a primary first mode of operation, the drive 1 has second, third, and fourth modes of operation 2*a*, 2*b* and 2*c*. A mode selector switch (not shown) controls shifting of a clutch pusher 4 of a multi-purpose hand-held power tool between the different modes of operation. In the third mode of operation 2*b*, the tool spindle 3 is fixedly secured with respect to the housing 5, and an operating pin, which is formed as an engagement cam 6, engages, without a possibility of rotation, in its switch position corresponding to the third mode of operation 2*b*, in a housing-side section recess 7. In its switch position corresponding to a fourth mode of operation 2*c*, which is provided between the switch positions corresponding to the second and third modes of operation, the rotatable engagement cam 6 is surrounded by a free space 8. The clutch pusher 4 is arranged transverse to the tool spindle 3 and is connected with a bevel pinion 10 for joint rotation therewith. The bevel pinion 10 cooperates with a pinion 9 provided on the tool spindle 3. The engagement cam 6 connects the clutch pusher 4 with driving gears 11, which are offset relative to each other, forming a step, for joint rotation therewith. The clutch pusher 4 is axially displaceable relative to the driving gears 11. The gears 11 have different rotational speeds in the first and second modes of operation.

As shown in FIG. 2, sector recesses 7 are formed in a retention sleeve 12 in which the clutch pusher 4 is received and which is form lockingly secured in a housing 5. The section recesses 7 are formed diametrically opposite each other.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiment within the spirit and scope of the present invention as defined by the appended claims.

What is claimed is:

1. A hand-held power tool with at least three switchable modes of operation, comprising a housing (5); a tool spindle (3) located in the housing and provided with a first bevel pinion (9) supported thereon; a clutch pusher (4) at least partially located in the housing and fixedly connected with a second bevel gear (10) for joint rotation therewith, the second bevel gear (10) engaging the first bevel gear (9); and at least one engagement cam (6) for connecting the clutch pusher (4) with driving gears (11) for joint rotation therewith with a possibility of axial displacement relative thereto in first and second modes of operation, which is obtained by displacement of the clutch pusher (4), wherein, in a third mode of operation, the spindle (3) is stopped without a possibility of rotation relative to the housing, and the engagement cam (6) engages in a recess (7) provided in the housing, wherein the tool has a fourth mode of operation, in which the spindle (3) is freely rotatable, and the engagement cam (7) rotates in a free space (8), and wherein a switch positions, which corresponds to the fourth mode of operation is located between switch positions corresponding to the second and third modes of operation.

2. A hand-held power tool according to claim 1, wherein the first and second modes of operation are associated with different rotational speeds.

3. A hand-held power tool according to claim 1, wherein the recess (7) is formed in a stop sleeve (12) fixedly secured in the housing.

4. A hand-held power tool according to claim 1, further comprising a mode selector switch for axially displacing the clutch pusher (4) between the different switchable positions corresponding to the different modes of operation.

* * * * *